US010553155B2

(12) United States Patent
Nakatani et al.

(10) Patent No.: US 10,553,155 B2
(45) Date of Patent: Feb. 4, 2020

(54) CURRENT LIMITING CIRCUIT, DISPLAY DEVICE, AND CURRENT LIMITING METHOD

(71) Applicant: JOLED INC., Tokyo (JP)

(72) Inventors: Toshikuni Nakatani, Tokyo (JP); Hirofumi Miyashita, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/991,865

(22) Filed: May 29, 2018

(65) Prior Publication Data

US 2019/0051240 A1 Feb. 14, 2019

(30) Foreign Application Priority Data

Aug. 9, 2017 (JP) ..... 2017-154537

(51) Int. Cl.

| | |
|---|---|
| ***G09G 3/3233*** | (2016.01) |
| ***G09G 3/3258*** | (2016.01) |
| ***G09G 3/3208*** | (2016.01) |
| ***G09G 3/20*** | (2006.01) |

(52) U.S. Cl.

CPC ..... *G09G 3/3233* (2013.01); *G09G 3/3208* (2013.01); *G09G 3/3258* (2013.01); *G09G 3/20* (2013.01); *G09G 2320/0295* (2013.01); *G09G 2320/041* (2013.01); *G09G 2330/021* (2013.01); *G09G 2330/025* (2013.01); *G09G 2330/028* (2013.01); *G09G 2330/04* (2013.01)

(58) Field of Classification Search

CPC ..... G09G 3/3233; G09G 3/3258

USPC ..... 345/76, 212, 690; 361/23, 87; 315/169.3, 381

See application file for complete search history.

(56) References Cited

U.S. PATENT DOCUMENTS

| | | | | |
|---|---|---|---|---|
| 5,488,533 | A * | 1/1996 | Cassidy | H02H 9/025 361/87 |
| 5,764,463 | A * | 6/1998 | Arvidson | A62C 5/02 361/23 |
| 6,271,710 | B1 | 8/2001 | Ooishi | |
| 6,937,288 | B2 * | 8/2005 | Hibi | H04N 5/59 315/381 |
| 8,072,241 | B2 * | 12/2011 | Kouno | H01L 29/7397 326/118 |
| 2001/0028278 | A1 | 10/2001 | Ooishi | |
| 2002/0053940 | A1 | 5/2002 | Ooishi | |
| 2003/0102901 | A1 | 6/2003 | Ooishi | |
| 2004/0008008 | A1 * | 1/2004 | Uematsu | H02H 7/06 322/28 |

(Continued)

FOREIGN PATENT DOCUMENTS

| | | |
|---|---|---|
| JP | 2006-155879 | 6/2006 |
| JP | 2006-285235 | 10/2006 |

*Primary Examiner* — Prabodh M Dharia

(74) *Attorney, Agent, or Firm* — Greenblum & Bernstein, P.L.C.

(57) ABSTRACT

A current limiting circuit is used in a display device which includes a display panel having pixels each of which includes a light emitting element and a panel power source which supplies an application voltage to be applied to each of the light emitting elements included in the pixels. The current limiting circuit detects a supply current supplied from the panel power source to the display panel, and reduces the application voltage when a value of the supply current detected is greater than a threshold.

7 Claims, 5 Drawing Sheets

(56) References Cited

U.S. PATENT DOCUMENTS

| | | | | |
|---|---|---|---|---|
| 2005/0104529 | A1* | 5/2005 | Park | G09G 3/32 315/169.3 |
| 2006/0001613 | A1* | 1/2006 | Routley | G09G 3/3216 345/76 |
| 2006/0221014 | A1 | 10/2006 | Park et al. | |
| 2007/0252567 | A1* | 11/2007 | Dearn | H02M 3/156 323/282 |
| 2010/0265277 | A1* | 10/2010 | Takahara | G09G 3/2014 345/690 |
| 2014/0198091 | A1* | 7/2014 | Shin | G09G 3/3233 345/212 |
| 2015/0138255 | A1* | 5/2015 | Yamashita | G09G 3/3233 345/690 |
| 2017/0076667 | A1* | 3/2017 | Numata | G09G 3/3258 |
| 2017/0206747 | A1* | 7/2017 | Miller | A63F 1/18 |
| 2018/0019745 | A1* | 1/2018 | Kimura | H03K 17/145 |
| 2018/0144683 | A1* | 5/2018 | Shin | G09G 3/3233 |
| 2019/0259325 | A1* | 8/2019 | Chaji | G09G 3/2074 |

* cited by examiner

CURRENT LIMITING CIRCUIT, DISPLAY DEVICE, AND CURRENT LIMITING METHOD

CROSS REFERENCE TO RELATED APPLICATION

The present application is based on and claims priority of Japanese Patent Application No. 2017-154537 filed on Aug. 9, 2017. The entire disclosure of the above-identified application, including the specification, drawings and claims is incorporated herein by reference in its entirety.

FIELD

The present disclosure relates to a current limiting circuit, a display device, and a current limiting method in the display device.

BACKGROUND

Conventionally, thin display devices, such as a liquid crystal display device and an organic electroluminescence (EL) display device, have been developed, and enlargement of display panels for such display devices is in demand. Accordingly, electric power consumed by a display device increases as a display panel enlarges. Thus, a technology for limiting, according to a light emitting area of a display panel, luminance of pixels of the display panel to reduce electric power consumed by a display device has been known (for example, see Patent Literature 1). A display device disclosed in Patent Literature (PTL) 1 calculates a total value of video data input to a frame, and when the total value is at least a predetermined value, limits luminance of pixels of the display panel. In this manner, electric power consumed by the display device is to be reduced.

CITATION LIST

Patent Literature

[PTL 1] Japanese Unexamined Patent Application Publication No. 2006-285235

SUMMARY

Technical Problem

However, the display device disclosed in Patent Literature 1 limits luminance, based on the result of calculating the total value of video data, and thus an image according to the video data may be displayed before a calculation of a total value of the video data completes. For example, when video data for which a light emitting area is larger is input to the display device subsequent to video data for which a light emitting area is smaller, an overcurrent temporarily flows into the display panel. For this reason, rated values of elements included in a circuit into which the overcurrent flows needs to be set in accordance with the overcurrent. Consequently, a size, a mounting area, and a cost of each element included in the circuit increase.

In order to address the problem as mentioned above, a method of providing, in a display device, a frame memory which stores video data may be considered. In the method, video data can be stored in the frame memory while calculating a total value of the video data, and an image according to the video data can be displayed after the calculation completes. In this manner, when the total value of the video data is at least a predetermined value, the image according to the video data can be displayed with reduced luminance. However, providing a frame memory in a display device complicates a configuration of the display device, and increases a cost of the display device.

The present disclosure has been conceived in view of the above problems, and an object thereof is to provide, for instance, a current limiting circuit which can assuredly limit a current to be supplied to a display panel and which has a simplified configuration.

Solution to Problem

In order to achieve the object, a current limiting circuit according to an aspect of the present disclosure is a current limiting circuit for use in a display device which includes: a display panel having pixels each of which includes a light emitting element; and a panel power source which supplies an application voltage to be applied to each of the light emitting elements included in the pixels, wherein the current limiting circuit: detects a supply current supplied from the panel power source to the display panel; and reduces the application voltage when a value of the supply current detected is greater than a threshold.

Also, in order to achieve the object, a display device according to an aspect of the present disclosure, the display device including: the current limiting circuit; the display panel; and the panel power source.

Furthermore, in order to achieve the object, a current limiting method according to an aspect of the present disclosure is the current limiting method for a display device which includes: a display panel having pixels each of which includes a light emitting element; and a panel power source which supplies an application voltage to be applied to each of the light emitting elements included in the pixels, the current limiting method including: detecting a supply current supplied from the panel power source to the display panel; and reducing the application voltage when a value of the supply current detected is greater than a threshold.

Advantageous Effects

According to the present disclosure, a current limiting circuit which can assuredly limit a current to be supplied to a display panel and which has a simplified configuration can be provided, for instance.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

The following describes embodiments of the present disclosure with reference to the drawings. The embodiments described below show specific examples according to the present disclosure. Therefore, the numerical values, shapes, materials, elements, the arrangement and connection of the elements, processes, the order of the processes, and the like described in the following embodiments are mere examples, and thus are not intended to limit the present disclosure. Accordingly, among the elements in the following exemplary embodiments, elements not recited in any of the independent claims defining the broadest concept of the present disclosure are described as arbitrary elements.

Note that the drawings are schematic diagrams, and do not necessarily provide strictly accurate illustration. Throughout the drawings, the same sign is given to substantially the same configuration, and redundant description is omitted or simplified.

Embodiment

[Whole Configuration of Display Device]

Firstly, a whole configuration of a display device according to an embodiment is described with reference to drawings.

Figure 1:
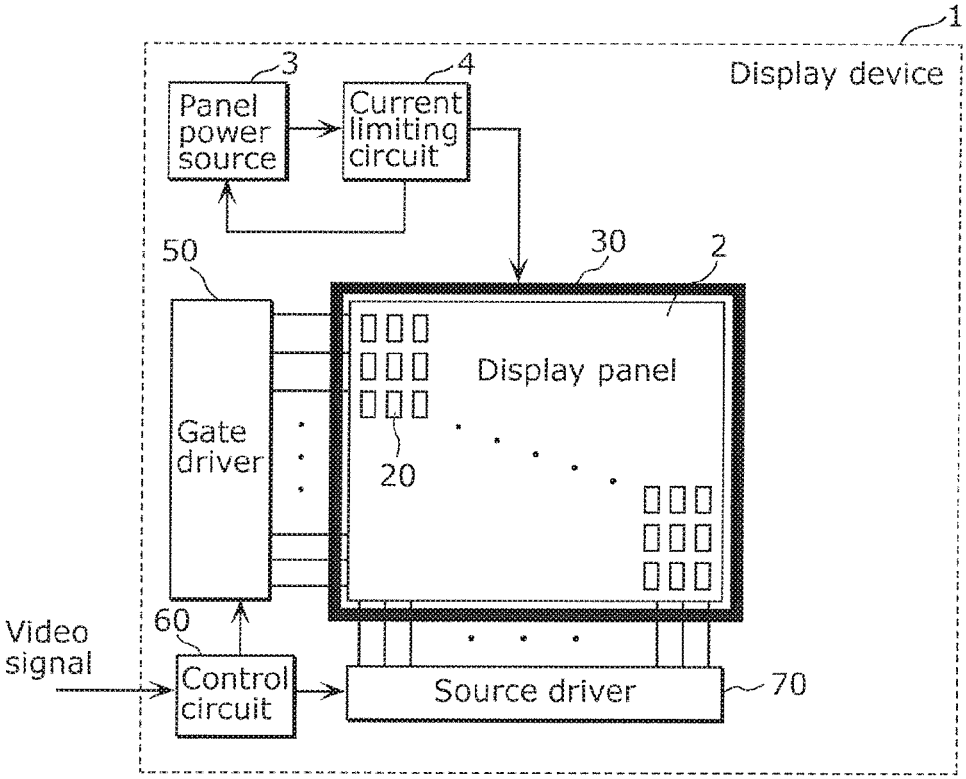
FIG. 1 is a functional block diagram showing a whole configuration of a display device according to an embodiment.

FIG. 1 is a functional block diagram showing the whole configuration of a display device 1 according to the present embodiment.

The display device 1 according to the present embodiment includes a display panel 2, a panel power source 3, a current limiting circuit 4, a gate driver 50, a source driver 70, and a control circuit 60.

The display panel 2 is a display unit having pixels 20 each of which includes a light emitting element. In the display panel 2, the pixels 20 are disposed in a matrix.

The Pixels 20 are elements that emit light in the display panel 2, and emission of light from the pixels 20 is controlled by signals from the source driver 70 and the gate driver 50. Each of the pixels 20 includes a light emitting element and a circuit element that drives the light emitting element to emit light.

The panel power source 3 supplies a power supply voltage to each pixel 20 through a feeder 30 disposed along an outer periphery of the display panel 2. More specifically, the panel power source 3 supplies an application voltage which is applied to each of the light emitting elements included in the pixels 20. According to the present embodiment, the panel power source 3 has a control terminal, and changes the output according to the control signal input to the control terminal. Specifically, the panel power source 3 reduces an output voltage when a control signal which indicates a higher voltage level than an internal reference voltage of the panel power source 3 is input to the control terminal.

The current limiting circuit 4 used in the display device 1 detects a supply current supplied from the panel power source 3 to the display panel 2, and when a value of the detected supply current is greater than a threshold, reduces the application voltage applied by the panel power source 3 to the light emitting element of a pixel 20. Details of the current limiting circuit 4 are to be described later.

The control circuit 60 controls the source driver 70 and the gate driver 50. The control circuit 60 generates, based on a video signal externally input, a gradation signal according to luminance of each of the light emitting elements, and outputs the generated gradation signal to the source driver 70. Also, the control circuit 60 generates, based on an input synchronized signal, a gate control signal for controlling the gate driver 50, and outputs the generated gate control signal to the gate driver 50. Specifically, the control circuit 60 includes a central processing unit (CPU) and a timing controller. In the control circuit 60, the CPU controls the timing controller, based on the input synchronized signal so that the timing controller outputs the gradation signal and the gate control signal to the source driver 70 and the gate driver 50, respectively.

Also, the control circuit 60 calculates, based on a video signal, a display area of the display panel 2, and limits a maximum value of luminance of each of the pixels 20 according to the display area. Here, the display area refers to a total area in which the pixels 20, among the pixels 20 in the display panel 2, emit light. Specifically, the control circuit 60 counts the number of the pixels 20 caused to, based on a video signal according to each of the pixels 20, emit light in the display panel 2, from the start of a frame period. When the number of the pixels 20 which emits light exceeds a predetermined number, the control circuit 60 limits a maximum value of the gradation signal output to the source driver 70. Here, a method of limiting luminance by the control circuit 60 is to be described with reference to drawings.

Figure 2:
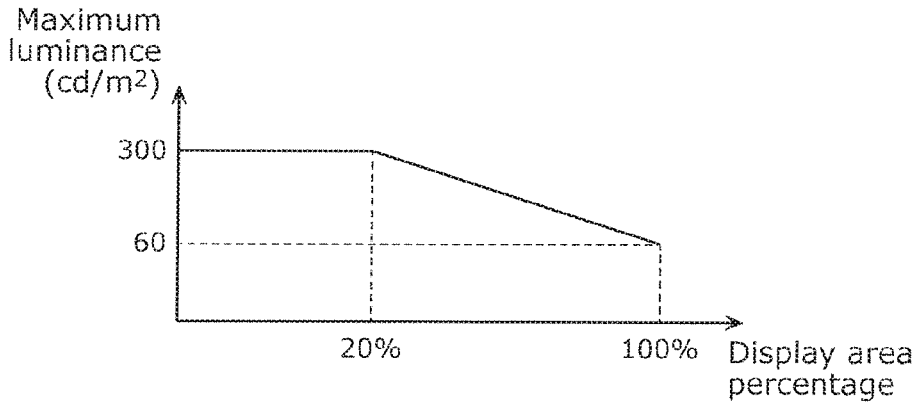
FIG. 2 is a graph showing an example of a relation between a display area percentage and a maximum luminance of the display device according to the embodiment.

FIG. 2 is a graph showing an example of a relation between a display area percentage and a maximum luminance of the display device 1 according to the present embodiment. The display area percentage shown in FIG. 2 is a proportion of the pixels 20 which emit light to a total number of the pixels 20.

As shown in FIG. 2, when the display area percentage exceeds 20%, the maximum luminance is reduced in proportion to the display area percentage. Specifically, when the display area percentage is at most 20%, the maximum luminance is 300 cd/m$^2$. In this case, the maximum value of the gradation signal is 1023, for example. On the other hand, when all the pixels 20 emit light, or when the display area percentage is 100% as shown in FIG. 2, the maximum luminance is 60 cd/m$^2$. In this case, the maximum value of the gradation signal is 205, for example. That is, according to the example shown in FIG. 2, when all the pixels 20 emit light, the control circuit 60 converts, based on an input video signal, a generated gradation signal into a signal having approximately a fifth of its original value, and outputs the resultant signal to the source driver 70. In this manner, even when a large number of the pixels 20 emit light, electric power consumed by the display device 1 can be reduced. Furthermore, when a large number of the pixels 20 emit light, even if luminance of the pixels 20 is limited, a user is less likely to perceive that the brightness of the image is low.

The source driver 70 outputs, based on the gradation signal generated by the control circuit 60, signals to data lines of the display panel 2. More specifically, the source driver 70 outputs, based on the gradation signal and a horizontal synchronizing signal, a video signal voltage (data voltage) to each of pixel circuits.

The gate driver 50 drives, based on the gate control signal generated by the control circuit 60, scan lines of the display panel 2, for instance. More specifically, the gate driver 50 outputs, for instance, a scan signal to each of the pixel circuits per at least display line, based on a vertical synchronizing signal and a horizontal synchronizing signal.

[Configuration of Pixel]

Next, a pixel 20 of the display 1 according to the present embodiment is to be described with reference to drawings.

Figure 3:
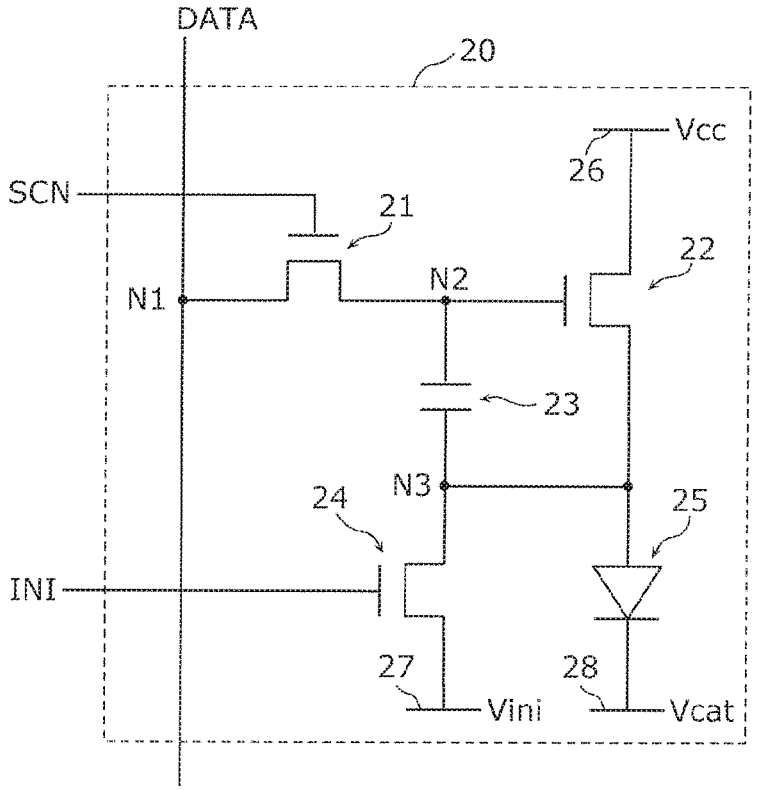
FIG. 3 is a circuit diagram showing an example of a circuit configuration of a pixel according to the embodiment.

FIG. 3 is a circuit diagram showing an example of a circuit configuration of a pixel 20 according to the present embodiment.

As shown in FIG. 3, the pixel 20 includes a scan line SCN, a data line DATA, an initialization control line INI, a selection transistor 21, a drive transistor 22, a storage capacitor 23, an initialization transistor 24, and a light emitting element 25.

The scan line SCN is connected to the gate driver 50 and a gate terminal of the selection transistor 21. A signal, from the gate driver 50, is input to the scan line SCN for controlling the selection transistor 21 so that the selection transistor 21 is conductive or non-conductive.

The data line DATA is connected to the source driver 70 and a source terminal of the selection transistor 21. The data voltage is applied from the source driver 70 to the data line DATA.

The initialization control line INI is connected to the gate driver 50 and a gate terminal of the initialization transistor 24. A signal, from the gate driver 50, is input to the initialization control line INI for controlling the initialization transistor 24 so that the initialization transistor 24 is conductive or non-conductive.

The selection transistor 21 has a gate terminal connected to the scan line SCN, and controls a timing of supplying a gate terminal of the drive transistor 22 with the data voltage applied to the data line DATA. According to the present embodiment, the selection transistor 21 is a thin film transistor (TFT). The source terminal of the selection transistor 21 is connected to the data line DATA at a node N1, and a drain terminal of the selection transistor 21 is connected, at a node N2, to the gate terminal of the drive transistor 22 and one of electrodes of the storage capacitor 23.

Drive transistor 22 controls a current that flows into the light emitting element 25. According to the present embodiment, the drive transistor 22 is a TFT. The drive transistor 22 has a gate terminal connected, through the selection transistor 21, to the data line DATA, a source terminal connected to an anode terminal of the light emitting element 25 (that is, a node N3), and a drain terminal connected to an anode power source line 26. Here, the panel power source 3 applies an application voltage Vcc to the anode power source line 26. The drive transistor 22 converts the data voltage supplied to the gate terminal into a signal current according to the data voltage, and supplies the converted signal current to the light emitting element 25.

The light emitting element 25 emits light at luminance according to the data voltage. According to the present embodiment, the light emitting element 25 is an organic EL element. A cathode terminal of the light emitting element 25 is connected to a cathode power source line 28. A voltage Vcat is applied to the cathode power source line 28. The anode terminal of the light emitting element 25 is connected, at the node N3, to the source terminal of the drive transistor 22, to the other of the electrodes of the storage capacitor 23, and to one of a source terminal and a drain terminal of the initialization transistor 24.

The initialization transistor 24 is a switching element which switches between electrical connection and disconnection between the node N3 and an initialization power source line 27. According to the present embodiment, the initialization transistor 24 is a TFT. The gate terminal of the initialization transistor 24 is connected to the initialization control line INI, one of the source terminal and the drain terminal of the initialization transistor 24 is connected to the node N3, and the other of the source terminal and the drain terminal of the initialization transistor 24 is connected to the initialization power source line 27. A voltage Vini is applied to the initialization power source line 27.

The storage capacitor 23 is for maintaining a gate voltage. One of the electrodes of the storage capacitor 23 is connected to the node N2, and the other of the electrodes of the storage capacitor 23 is connected to the node N3. For example, even after the selection transistor 21 is brought into the off state, the storage capacitor 23 can maintain a gate voltage of the drive transistor 22 applied immediately before the selection transistor 21 is brought into the off state, and allows the drive transistor 22 to continuously supply a driving current to the light emitting element 25.

In addition, the application voltage Vcc from the anode power source line 26 is applied to the anode terminal of the light emitting element 25 through the drive transistor 22. The voltage Vcat is applied from the cathode power source line 28 to the cathode terminal of the light emitting element 25. The anode power source line 26 and the cathode power source line 28 are each connected to the panel power source 3, and the voltages are applied to the anode power source line 26 and the cathode power source line 28.

A data voltage supplied from the source driver 70 is applied to the gate terminal of the drive transistor 22 through the selection transistor 21. A current according to the data voltage flows between the source and drain terminals of the drive transistor 22. As the current flows into the light emitting element 25, the light emitting element 25 emits light at luminance according to the current.

Note that in the circuit configuration of the pixel 20 shown in FIG. 3, a different circuit element and a different wire, for instance, may be added in a path that connects circuit elements.

[Current Limiting Circuit]

Next, a current limiting circuit according to the present embodiment is to be described with reference to drawings.

Figure 4:
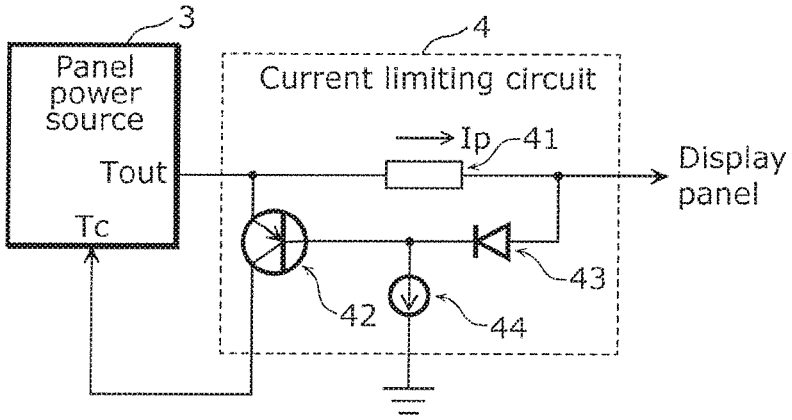
FIG. 4 is a circuit diagram showing an example of a circuit configuration of the current limiting circuit according to the embodiment.

FIG. 4 is a circuit diagram showing an example of a circuit configuration of the current limiting circuit 4 according to the present embodiment. Note that the panel power source 3 is also shown in FIG. 4. As shown in FIG. 4, the current limiting circuit 4 includes a current detection element 43, a control element 42, a resistance element 41, and a constant current source 44.

The current detection element 43 outputs a detection signal according to a supply current Ip supplied from the panel power source 3 to the display panel 2. According to the present embodiment, the current detection element 43 is a diode.

The control element 42 outputs, according to the detection signal input from the current detection element 43, a control signal to control terminal Tc of the panel power source 3. According to the present embodiment, the control element 42 is a transistor. More specifically, the control element 42 is a bipolar transistor. A base terminal of the control element 42 is connected to a cathode terminal of the current detection element 43. An emitter terminal of the control element 42 is connected to an output terminal Tout of the panel power source 3. A collector terminal of the control element 42 is connected to the control terminal Tc of the panel power source 3. In this manner, a voltage according to a voltage drop in the resistance element 41 is applied between the base terminal and the emitter terminal of the control element 42. Here, the voltage drop in the resistance element 41 is according to the magnitude of a supply current Ip, and thus the control element 42 outputs, from the collector terminal, a control signal according to the magnitude of the supply current Ip to the panel power source 3. According to the present embodiment, when a value of the supply current Ip is greater than the predetermined threshold, a control signal, which indicates higher voltage level than the internal reference voltage of the panel power source 3, is output to the control terminal Tc of the panel power source 3.

As described above, the current limiting circuit 4 which makes a response at a fast speed and has a simplified configuration can be realized by using a bipolar transistor as the control element 42. In addition, an improvement in the response speed of the current limiting circuit 4 can prevent the supply current Ip from increasing considerably from a threshold. That is to say, this improvement can limit a peak value of the supply current Ip.

The resistance element 41 is a sense resistor for detecting the supply current Ip supplied from the panel power source 3 to the display panel 2. The resistance element 41 is inserted in an electric wire which connects the panel power source 3 and the anode power source line 26 of the display panel 2. In addition, one of terminals of the resistance element 41 is connected to the output terminal Tout of panel power source 3 and the emitter terminal of the control element 42, and the other of the terminals of the resistance element 41 is connected to the anode terminal of the current detection element 43. Note that a shape, for instance, of the resistance element 41 is not particularly limited. For example, a resistance component of the electric wire can be used as the resistance element 41.

The constant current source 44 stabilizes a current that flows through the current detection element 43. According to the present embodiment, the constant current source 44 is used for adjusting a temperature characteristic of the current detection element 43.

[Operation]

Next, operation of the current limiting circuit 4 according to the present embodiment and operation of the display 1 according to the present embodiment are to be described with reference to drawings.

Figure 5:
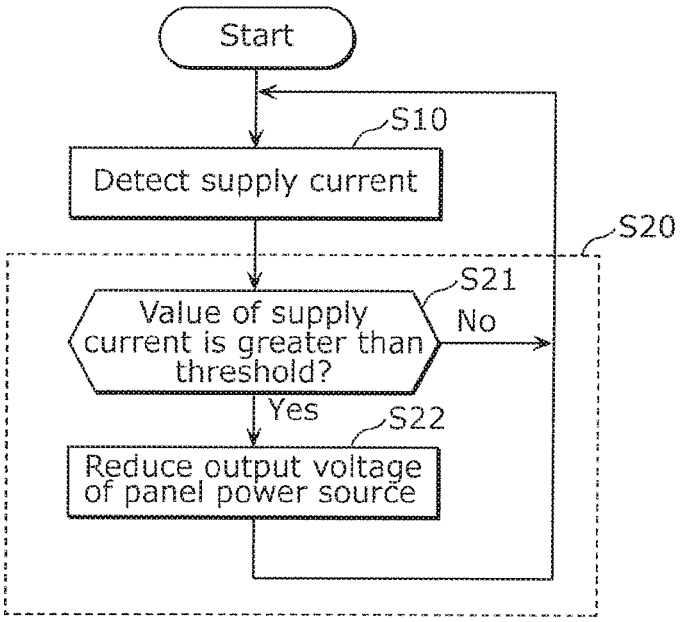
FIG. 5 is a flowchart showing a method of controlling a supply current supplied from a panel power source to a display panel, according to the embodiment.

FIG. 5 is a flowchart showing a method of controlling a supply current supplied from the panel power source 3 to the display panel 2, according to the present embodiment.

First, as shown in FIG. 5, a supply current Ip supplied from the panel power source 3 to the display panel 2 is detected (S10). According to the present embodiment, the current detection element 43 detects a detection signal according to the supply current Ip.

Next, the supply current Ip is limited according to a value of the supply current Ip detected (S20). Specifically, whether the value of the detected supply current Ip is greater than the predetermined threshold is determined (S21). According to the present embodiment, whether a detection signal detected by the current detection element 43 exceeds a value according to the threshold of the supply current Ip is determined. The detection signal is input to the base terminal of the control element 42. Accordingly, a voltage according to a voltage drop in the resistance element 41 is applied between the base and the emitter terminals of the control element 42.

When the value of the supply current Ip is greater than the predetermined threshold (Yes in S21), the current limiting circuit 4 reduces an output voltage of the panel power source 3 (522). Specifically, when the detection signal exceeds a value according to the threshold of the supply current Ip, the control element 42 inputs a control signal which indicates a high voltage level to the control terminal Tc of the panel power source 3. The panel power source 3 reduces the output voltage output from the output terminal Tout when the control signal which indicates a higher voltage level than the internal reference voltage of the panel power source 3 is input to the control terminal Tc. Consequently, the application voltage Vcc applied to a light emitting element 25 is reduced, and thus a current that flows into the light emitting element 25 is decreased. That is, a current which flows into the light emitting element 25 included in each of the pixels 20 is reduced, and thus the supply current Ip is decreased. In this manner, the supply current Ip can be assuredly limited according to the present embodiment.

On the other hand, when the value of the supply current Ip is at most the predetermined threshold (No in S21), the current limiting circuit 4 returns to step S10 without limiting the supply current Ip.

As described above, the current limiting circuit 4 according to the present embodiment can limit the supply current Ip. However, the control element 42 has a temperature dependent character, and thus may not be able to appropriately limit the supply current Ip when a temperature is not constant. Accordingly, in the present embodiment, a configuration for reducing the temperature dependence of the control element 42 is provided. Hereinafter, such a configuration is to be described.

First, a temperature characteristic of the control element 42 is to be described with reference to drawings.

Figure 6:
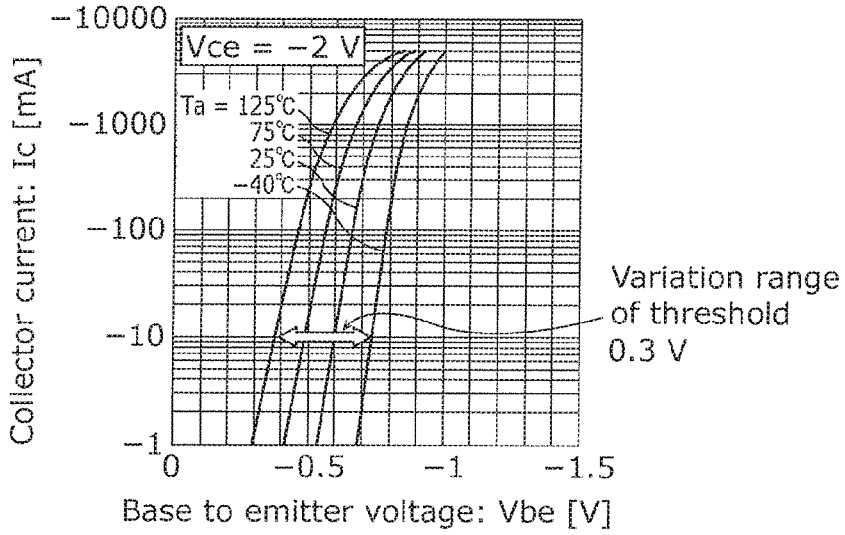
FIG. 6 is a graph showing a temperature characteristic of a control element according to the embodiment.

FIG. 6 is a graph showing a temperature characteristic of the control element 42 according to the present embodiment. In FIG. 6, a graph which shows a relation between a base to emitter voltage Vbe and a collector current Ic of the control element 42 in the case where an ambient temperature Ta ranges from −40° C. to 125° C. is shown. Note that the graph shown in FIG. 6 shows the temperature characteristic when a collector to emitter voltage Vce of the control element 42 is −2 V.

As shown in FIG. 6, the base to emitter voltage Vbe at which the collector current Ic starts to flow, or in other words, a threshold voltage of the control element 42 varies depending on the ambient temperature Ta. In the examples shown in FIG. 6, the threshold voltage varies in the range of about 0.3 V. For this reason, when the ambient temperature Ta changes, the current limiting circuit 4 may not be able to appropriately limit a current. For example, when the ambient temperature Ta is low, the threshold voltage increases and thus the threshold of the current Ip increases when compared to the case where the ambient temperature Ta is high. Consequently, a large supply current Ip may flow.

According to the present embodiment, in order to reduce the temperature dependence of the control element 42, temperature dependence of the current detection element 43 is used. Hereinafter, a method for reducing the temperature dependence according to the embodiment is to be described with reference to drawings.

Figure 7:
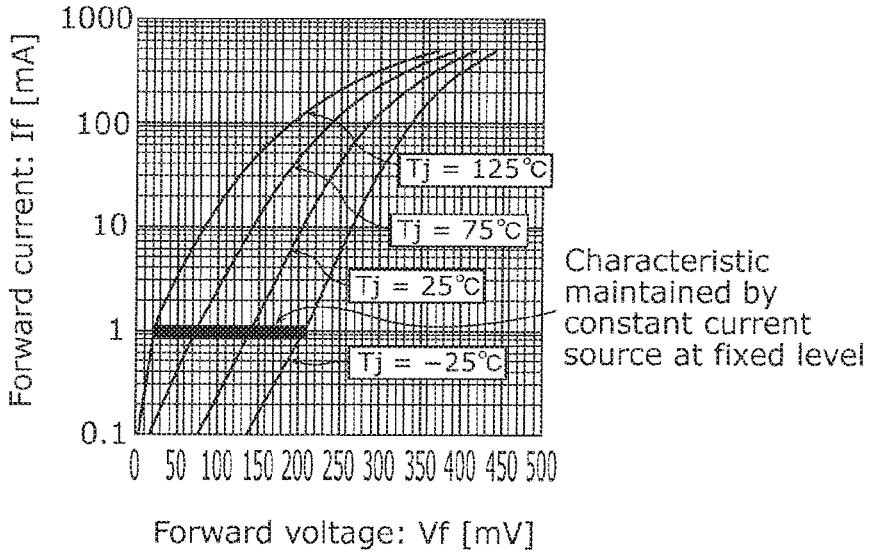
FIG. 7 is a graph showing a temperature characteristic of a current detection element according to the embodiment.

FIG. 7 is a graph showing a temperature characteristic of the current detection element 43 according to the present embodiment. FIG. 7 illustrates a graph which shows a relation between a forward voltage Vf and a forward current If of the current detection element 43 in the case where a junction temperature Tj ranges from −25° C. to 125° C.

As shown in FIG. 7, the forward voltage Vf of the current detection element 43 increases as the temperature decreases. That is, both the base to emitter voltage Vbe of the control element 42 and the forward voltage Vf of the current detection element 43 increase as the temperature decreases. Here, a voltage which is a sum of a voltage drop of the resistance element 41 and the forward voltage Vf of the current detection element 43 is applied between the base and the emitter terminals of the control element 42. For this reason, at least a part of the base to emitter voltage Vbe of the control element 42 which increases when the temperature decreases can be offset by an increase in the forward voltage Vf of the current detection element 43. In other words, the temperature dependence of a detection signal output by the current detection element 43 can reduce the temperature dependence of a control signal output by the control element 42.

According to the present embodiment, the constant current source 44 is used to constantly maintain a current that flows into the current detection element 43 in order to further reduce the temperature dependence of a control signal output by the control element 42. In this manner, as shown in FIG. 7, the temperature dependence of the current detection element 43 can be maintained at a fixed level. Thus, the temperature characteristic of the current detection element 43 can be fixedly set to a desired temperature characteristic by adjusting a current value of the constant current source 44. Thus, the temperature dependence of a control signal output by the control element 42 can be further reduced by adjusting the temperature dependence of the current detection element 43. According to the present embodiment, the temperature dependence of the control signal output by the control element 42 can be reduced to about one tenth of the temperature dependence as compared with the case where the current detection element 43 is not used, for example. Hereinafter, effects of reducing the temperature dependence of the control signal are to be described with reference to drawings.

Figure 8:
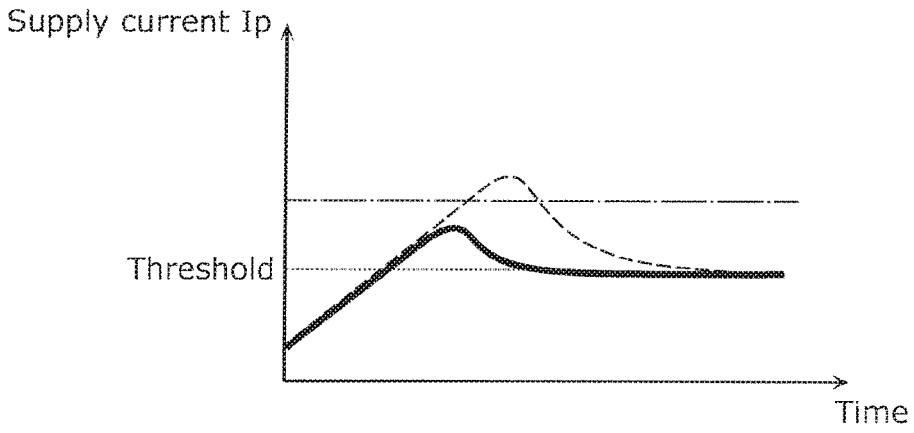
FIG. 8 is a graph schematically showing an example of a waveform of a supply current supplied from the panel power source to the display panel, according to the embodiment.

FIG. 8 is a graph schematically showing an example of a waveform of a supply current supplied from the panel power source 3 to the display panel 2, according to the present embodiment. In FIG. 8, the waveform of a supply current Ip which flows when a state of the display panel 2 is changed from a state of entire black surface (entire-black state) to a state of entire white surface (entire-white state) is shown.

As the solid line in the graph in FIG. 8 indicates, when the state is changed from the entire-black state to the entire-white state, the supply current Ip rapidly increases and may continue to increase until processing is performed for reducing a maximum value of a gradation signal in the control circuit 60 of the display device 1. Ideally, when the supply current Ip exceeds the predetermined threshold indicated by the dotted line, the supply current Ip is limited by the current limiting circuit 4 having a faster response speed than a speed of the processing performed by the control circuit 60. As the processing performed by the control circuit 60 follows, the supply current Ip can be maintained at the threshold or below.

However, the threshold voltage of the control element 42 of the current limiting circuit 4 actually is temperature dependent as described above, and thus the threshold of the supply current Ip may be changed to a value indicated by the dashed-and-dotted line in FIG. 8, for example. In this case, the supply current Ip changes as indicated by the broken line in FIG. 8. That is, a difference between the peak value of the supply current Ip and the threshold of the supply current Ip (the value indicated by the dotted line in FIG. 8) may approximately double an ideal difference. On the other hand, in the present embodiment, the temperature dependence of the control signal output by the control element 42 can be reduced by the temperature dependence of the detection signal output by the current detection element 43, as described above. Accordingly, in the current limiting circuit 4 and in the display device 1 according to the present embodiment, rated values of elements of a circuit into which the supply current Ip flows can be limited, and thus sizes, mounting areas, and costs of elements included in the circuit can be reduced.

[Conclusion]

As described above, the current limiting circuit 4 according to the present embodiment is the current limiting circuit 4 for use in the display device 1 which includes: the display panel 2 having the pixels 20 each of which includes a light emitting element 25; and the panel power source 3 which supplies an application voltage to be applied to each of the light emitting elements 25 included in the pixels 20, wherein the current limiting circuit 4: detects a supply current Ip supplied from the panel power source 3 to the display panel 2; and reduces the application voltage when a value of the supply current Ip detected is greater than a threshold.

Reducing the application voltage according to the detected supply current Ip can assuredly limit the supply current Ip. In addition, the current limiting circuit 4 can be realized with a configuration simpler than a configuration that limits the supply current IP using a frame memory, for instance.

In addition, the current limiting circuit 4 may include the current detection element 43 which outputs a detection signal according to the supply current Ip; and the control element 42 which outputs, according to the detection signal, a control signal to the panel power source 3.

In this manner, the current limiting circuit 4 can be realized with a simplified configuration.

In addition, in the current limiting circuit 4, temperature dependence of the detection signal output by the current detection element 43 may reduce temperature dependence of the control signal output by the control element 42.

In this manner, the temperature dependence of the control signal output by the control element 42 can be reduced, and thus the temperature dependence of a threshold as a reference value for limiting the supply current Ip can be reduced. Accordingly, rated values of elements of a circuit into which the supply current Ip flows can be limited, and thus sizes, mounting areas, and costs of elements included in the circuit can be reduced.

In addition, in the current limiting circuit 4, the current detection element 43 is a diode, and the control element 42 is a transistor.

In this manner, the current limiting circuit 4 having a fast response speed can be realized. Accordingly, the peak value of the supply current Ip can be reduced.

In addition, the current limiting circuit 4 may further include the constant current source 44 which stabilizes a current which flows through the current detection element 43.

In this manner, the temperature characteristic of the current detection element 43 can be adjusted by adjusting the current that flows into the constant current source 44.

In addition, the display device 1 according to the present embodiment includes the current limiting circuit 4; the display panel 2; and the panel power source 3.

In this manner, the display device 1 can yield a same effect as the current limiting circuit 4.

In addition, a current limiting method according to the present embodiment is the current limiting method for the display device 1 which includes: the display panel 2 having pixels 20 each of which includes a light emitting element 25; and the panel power source 3 which supplies an application voltage to be applied to each of the light emitting elements 25 included in the pixels 20, the current limiting method including: detecting a supply current Ip supplied from the panel power source 3 to the display panel 2; and reducing the application voltage when a value of the supply current Ip detected is greater than a threshold.

Limiting the supply current Ip according to the detected supply current Ip in the above way can assuredly limit the supply current Ip. In addition, such a current limiting method can be realized with a configuration simpler than a configuration used in a method of limiting the supply current IP using a frame memory, for instance.

In addition, in the current limiting method according to the present embodiment, in detecting the supply current, a detection signal is output according to the supply current Ip, in reducing the application voltage, a control signal is output, according to the detection signal, to the panel power source 3, and temperature dependence of the detection signal may reduce temperature dependence of the control signal.

In this manner, the temperature dependence of a control signal can be reduced, and thus the temperature dependence of the threshold for limiting the supply current Ip can be reduced. Accordingly, rated values of elements of a circuit into which the supply current Ip flows can be limited, and thus sizes, mounting areas, and costs of elements included in the circuit can be reduced.

[Other Embodiment]

The foregoing has described the current limiting circuit, for instance, according to the present disclosure based on the embodiments, yet the current limiting circuit, for instance, according to the present disclosure is not limited to such embodiments. A different embodiment achieved by combining arbitrary elements according to the embodiments, a variation obtained, without departing from the scope of the present disclosure, by making to the embodiments various modifications which may be conceived by a person skilled in the art, and various devices that includes the display device according to the present embodiment are also included in the present disclosure.

For example, the above embodiment shows an example in which the current limiting circuit 4 is configured using a diode and a bipolar transistor, yet the configuration of the current limiting circuit 4 is not limited to such a configuration. For example, the current limiting circuit 4 may be realized using, for instance, a comparator which compares a supply current Ip with a reference value.

In addition, the above embodiment shows an example in which an organic EL device is used as a light emitting element, yet the light emitting element is not limited to such a light emitting element. For example, an inorganic EL device, for instance, can be used as a light emitting element.

Figure 9:
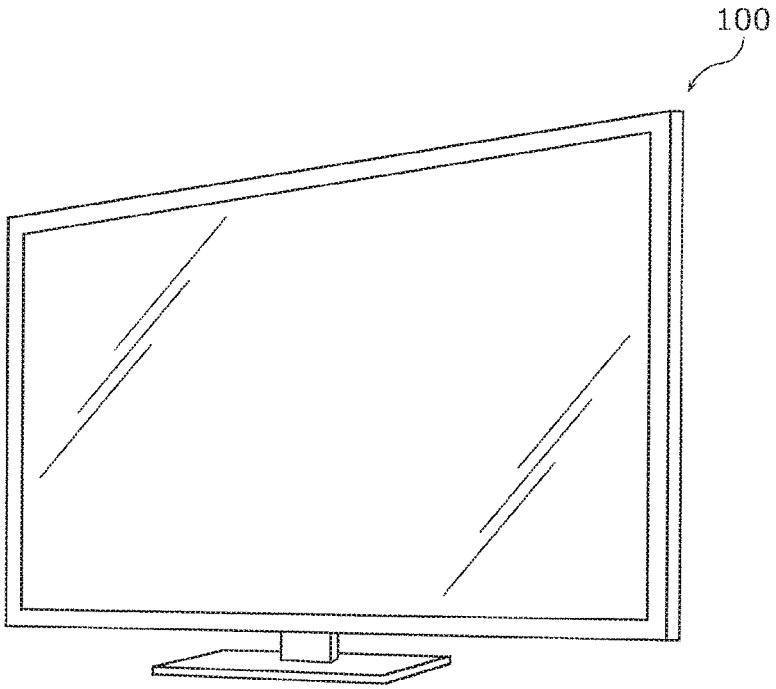
FIG. 9 is a diagram showing an appearance of a thin flat screen TV that includes the display device according to the embodiment.

In addition, the display device 1 according to the embodiment is included in thin flat TV 100 as shown in FIG. 9, for example. A thin flat screen TV which can assuredly limit the supply current Ip and which has a simplified configuration can be realized by the display device 1 according to the present embodiment.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is useful for an organic EL flat-panel display, and particularly suitable for use in a large-sized display that consumes a large amount of electric power.

The invention claimed is:

1. A current limiting circuit for use in a display device that includes:

a display panel having pixels each of which includes a light emitting element; and a panel power source that supplies an application voltage to be applied to each of the light emitting elements included in the pixels, wherein the current limiting circuit includes a current detection element that detects a supply current supplied from the panel power source to the display panel;

a constant current source, connected to the current detection element, that stabilizes a current that flows through the current detection element; and a control element, connected to the current detection element, that reduces the application voltage when a value of the supply current detected is greater than a threshold value.

2. The current limiting circuit according to claim 1, wherein the current detection element outputs a detection signal according to the supply current; and the control element outputs, according to the detection signal, a control signal to the panel power source.

3. The current limiting circuit according to claim 2, wherein temperature dependence of the detection signal output by the current detection element reduces temperature dependence of the control signal output by the control element.

4. The current limiting circuit according to claim 2, wherein the current detection element is a diode, and the control element is a transistor.

5. A display device, comprising:

the current limiting circuit according to claim 1.

6. A current limiting method for a display device, which includes a display panel having pixels, each of which includes a light emitting element; and a panel power source that supplies an application voltage to be applied to each of the light emitting elements included in the pixels, the current limiting method comprising:

detecting a supply current, by a current detection element in a current limiting circuit, that is supplied from the panel power source to the display panel;

stabilizing a current that flows through the current detection element, by a constant current source connected to the current detection element; and reducing the application voltage, by a control element connected to the current detection element, when a value of the supply current detected is greater than a threshold value.

7. The current limiting method according to claim 6, wherein in detecting the supply current, a detection signal is output according to the supply current, in reducing the application voltage, a control signal is output, according to the detection signal, to the panel power source, and temperature dependence of the detection signal reduces temperature dependence of the control signal.

* * * * *